US010023268B2

(12) United States Patent
Green

(10) Patent No.: US 10,023,268 B2
(45) Date of Patent: Jul. 17, 2018

(54) MOONPOOL WORK TABLE

(71) Applicant: TECHNIP FRANCE, Courbevoie (FR)

(72) Inventor: Andrew Green, Invurie (GB)

(73) Assignee: TECHNIP FRANCE (FR)

( * ) Notice: Subject to any disclaimer, the term of this patent is extended or adjusted under 35 U.S.C. 154(b) by 0 days.

(21) Appl. No.: 15/310,973

(22) PCT Filed: Apr. 30, 2015

(86) PCT No.: PCT/IB2015/000856
§ 371 (c)(1),
(2) Date: Nov. 14, 2016

(87) PCT Pub. No.: WO2015/173634
PCT Pub. Date: Nov. 19, 2015

(65) Prior Publication Data

US 2017/0113761 A1 Apr. 27, 2017

(30) Foreign Application Priority Data

May 15, 2014 (GB) ..... 1408653.2

(51) Int. Cl.
*B63B 3/54* (2006.01)
*B63B 19/18* (2006.01)
(Continued)

(52) U.S. Cl.
CPC ..... *B63B 3/54* (2013.01); *B63B 3/14* (2013.01); *B63B 19/14* (2013.01); *B63B 19/18* (2013.01);
(Continued)

(58) Field of Classification Search
CPC ..... B63B 2003/147; B63B 3/14; B63B 3/54; B63B 17/00; B63B 19/00; B63B 19/12;
(Continued)

(56) References Cited

U.S. PATENT DOCUMENTS 4,505,614 A * 3/1985 Anschutz ..... E21B 17/1007 175/220
4,512,408 A 4/1985 Danielson et al.
(Continued)

FOREIGN PATENT DOCUMENTS

EP 2 685 146 A1 1/2014
JP 10280854 A * 10/1998
(Continued)

OTHER PUBLICATIONS

International Search Report dated Oct. 29, 2015 issued in corresponding International patent application No. PCT/IB2015/000856.
(Continued)

*Primary Examiner* — Ajay Vasudeva
(74) *Attorney, Agent, or Firm* — Ostrolenk Faber LLP

(57) ABSTRACT

A moonpool work table able to provide an opening to a moonpool including a first set of opposing table doors having opposing vertical faces and moveable between an open position and one or more closed positions, and a second set of opposing table doors moveable between an open position and one or more closed positions in a transverse direction to that of the first set of table doors. In this way, the first and second set of table doors are able to define a "box" that can more closely and tightly define the area or envelope through which a conduit or the like can pass.

16 Claims, 13 Drawing Sheets

(51) Int. Cl.
*B63B 35/03* (2006.01)
*B63B 3/14* (2006.01)
*B63B 19/14* (2006.01)

(52) U.S. Cl.
CPC ..... *B63B 35/03* (2013.01); *B63B 2003/147* (2013.01)

(58) Field of Classification Search
CPC ... B63B 19/14; B63B 19/18; B63B 2019/185; B63B 35/03; B63B 35/04
See application file for complete search history.

(56) References Cited

U.S. PATENT DOCUMENTS 4,545,437 A * 10/1985 Denison ..... E21B 17/012 166/345
4,557,332 A * 12/1985 Denison ..... E21B 17/012 166/345
5,348,423 A 9/1994 Maloberti et al.
6,352,046 B1 3/2002 Berg et al.
6,988,459 B2 * 1/2006 Roodenburg ..... B63B 15/00 114/201 R
8,327,783 B2 12/2012 Son et al.
8,992,152 B2 * 3/2015 Nouwens et al. .... E21B 19/155 414/22.55
2005/0019100 A1 * 1/2005 Simpson ..... F16L 1/19 405/166
2014/0161535 A1 * 6/2014 Machado Guigon De Araujo ..... B63B 35/03 405/168.4

FOREIGN PATENT DOCUMENTS

WO WO 97/18987 A1 5/1997
WO WO 2004/020275 A2 3/2004
WO WO 2012/146622 A1 11/2012
WO WO 2013167805 A1 * 11/2013 ..... B63B 3/14

OTHER PUBLICATIONS

International Preliminary Examination Report on Patentability and Written Opinion of the International Searching Authority dated Nov. 15, 2016 in corresponding International Application No. PCT/IB2015/000856 (6 total pages).
Combined Search and Examination Report dated Nov. 17, 2014 in corresponding United Kingdom Patent Application No. GB1408653.2 (5 total pages).

* cited by examiner

-- PRIOR ART --

-- PRIOR ART --

-- PRIOR ART --

MOONPOOL WORK TABLE

CROSS-REFERENCE TO RELATED APPLICATIONS

The present application is a 35 U.S.C. §§ 371 national phase conversion of PCT/IB2015/000856, filed Apr. 30, 2015, which claims priority to United Kingdom Patent Application No. 1408653.2, filed May 15, 2014, the contents of which are incorporated herein by reference. The PCT International Application was published in the English language.

TECHNICAL FIELD OF THE INVENTION

The present invention relates to moonpools, in particular to a moonpool work table, and a vessel having such a moonpool.

BACKGROUND OF THE INVENTION

Moonpools are well known in the art, and generally comprise a vertical passageway through a floating structure, often a vessel, through which operations can be directed wholly or substantially vertically, without the need for operating 'over the side' of the vessel.

Generally, moonpools have a 'work table', i.e. one set of retractable opposing doors movable between a horizontal retracted or open position providing an opening into the moonpool, and a number of closed positions where the opposing faces of the doors are brought closer together, often in a complementary fashion, to reduce the open area thereinbetween and to provide the working area or platform around the reduced opening between the doors. Where the opposing doors completely meet, the moonpool is effectively closed or shut, which would be the normal operation when the moonpool is not required.

The open area between the doors allows the passage of an apparatus, device, unit etc. through the opening. One such apparatus is a conduit, generally an elongate conduit, which is intended either to be laid into the water, generally the sea, or recovered therefrom. A typical example is a pipeline to be used in the production of hydrocarbons, especially an offshore pipeline that is intended to be laid on, in or near the seabed.

In particular, moonpools are useful for the laying of rigid pipelines where the direction of the pipeline from its storage on the vessel into the sea (and then down to its laying position, often in, on or next to the seabed) is critical. Commonly, the direction is guided by one or more guide means, in particular caterpillar tracks or the like, located along a neighbouring tower and in line with the moonpool.

Where the conduit has a regular outer dimension i.e. a constant diameter, the front edges of the moonpool doors can be located closely thereto. Optionally one or more transverse but isolated deflector plates are further operated to buffer against the conduit and maintain it in the desired trajectory envelope as it passes through the moonpool and away from the vessel. Where an accessory is desired to be added to the conduit, or indeed any other change in the shape or circumference of the item passing through the moonpool occurs, the moonpool work table doors can be retracted to increase the size of the moonpool opening to allow the accessory therethrough, prior to being retracted where the diameter of the conduit, etc. is again constant.

Such arrangements and operations are well known in the art. However, existing moonpools have a number of disadvantages. In particular, with the use of isolated extendible supports, there is no tolerance should the conduit move away from the expected trajectory. Crude and usually manual methods are required to retrieve the conduit back into its intended trajectory prior to reapplying the moonpool doors or supports. Secondly, existing moonpools have sharp edges that could damage a conduit or any accessory. Thirdly, the "capture area", size of the opening within an existing moonpool is relatively small and fixed.

SUMMARY OF THE INVENTION

It is an object of the present invention to provide an improved moonpool work table, a moonpool including such an improved work table, and indeed a vessel having such a moonpool.

Thus, according to one aspect of the present invention, there is provided a moonpool work table able to provide an opening to a moonpool comprising a first set of opposing table doors having opposing vertical faces and moveable between an open position and one or more closed positions, and a second set of opposing table doors moveable between an open position and one or more closed positions in a transverse direction to that of the first set of table doors.

In this way, the first and second set of table doors are able to define a "box" that can more closely and tightly define the area or envelope through which a conduit or the like can pass.

Optionally, all the first and second doors of the work table move wholly or substantially horizontally relative to the moonpool, and the deck or part of the vessel having the moonpool. Preferably, all the doors operate in a sliding manner, i.e. backwards and forwards in a horizontal direction.

Optionally, all the first and second doors of the work table define the edges or the outline of the moonpool, i.e. the edges or outline of the vertical passageway through the floating structure, often a vessel, having the moonpool.

The first set of table doors optionally extend across the width of the moonpool, and are moveable between a retracted or open position able to provide the greatest extent of opening between the first set of table doors, and any number of closed positions. One closed position is the width of the second set of table doors. A final closed position may be where the first set of table doors wholly or substantially meet so as to shut the moonpool during non-use.

The term "retractable" is sometime used to relate to a table door being moveable in both a closing and an opening direction or arrangement.

Any door movement defined herein may be in a complementary or symmetrical opposing motion with an opposing door, but is not limited thereto. That is, the invention extends to asymmetric movement and/or individual movement of opposing table doors, including movement of only one door.

The second set of table doors is generally smaller than the first set of table doors. Optionally, each table door of the second set is attachable to one table door of the first set, and is supported thereby, generally along one edge, whilst still being relatively moveable in a transverse direction.

Each table door is generally moveable in a horizontal direction, and maybe moved by any suitable arrangement, unit or device, such as one or more actuators, including hydraulic actuators, ram and pistons, etc.

Optionally, each of the first set of table doors comprises a series of panels. One or more such panels may be fixed or otherwise static, and one or more other panels may be moveable to create the overall effect of the first set of table doors being moveable between an open position and one or more closed positions. Such panels may have a telescopic or cascading arrangement.

Each table door of the first set of table doors has a vertical face. The vertical faces generally extend downwardly from the front edge of each table door of the first set, optionally with a smooth cornering from the table door to the vertical face.

In one embodiment of the present invention, the vertical faces of the first set of table doors curve inwardly towards the table doors from their top to their bottom. That is, the spacing between the vertical faces of these table doors increases from their top to their bottom, and is more constricted at the top of the vertical faces. In this way, there can be closer guidance of the item passing through the moonpool, such as a conduit, at the guiding part of the moonpool.

The vertical faces of the first set of table doors generally extend across the width of the first set of table doors, and optionally they extend to a width greater then the opening between the second set of table doors in their open position. This avoids any possible sharp edges and allows the operation of the second set of table doors to create a deflector box through their combination with the vertical faces, as discussed in more detail below.

The second set of table doors are moveable between their retracted or open position, able to provide the greatest extent of opening into a moonpool between the second set of table doors, and any number of closed positions, i.e. any position wherein the spacing between the second set of table doors is reduced. The final closed position of the second set of table doors may be where the table doors wholly or substantially meet so as to wholly or substantially shut the moonpool during non-use as discussed in more detail below.

According to one embodiment of the present invention, each of the second set of table doors includes a vertical face. Preferably, such vertical faces extend downwardly from the front edge of each table door of the second set. Each vertical face may extend downwardly wholly or substantially in a complementary manner with the path of the vertical faces of the first set of table doors so as to provide a regular downward corner thereinbetween.

Where the vertical faces of the first set of table doors curve inwardly towards the table doors from their top to their bottom, optionally the vertical faces of the second set of table doors taper outwardly from their top to their bottom, preferably tapering outwardly in a complementary manner to the inward curvature of the vertical faces of the first set of table doors.

Preferably, the vertical faces of the second set of table doors are equal and opposite.

Where the edges of the first and second table doors meet, such that the first set of table doors are in their closed position with the second set of table doors thereinbetween, the edges form a constricted opening to the moonpool and provide best guidance for an item, in particular a conduit, therethrough and down into the moonpool and beyond. Where the vertical faces of the first and second table doors also all meet, they create a 'box' for the guided passage of the item. Where the vertical faces then also curve and taper as discussed above, the box created by the vertical faces increases downwardly towards the moonpool to provide an opening funnel arrangement from the opening created by the edges of the table doors.

Optionally, each table door of the first set of table doors of the moonpool work table is moveable independently.

Optionally, each table door of the second set of table doors of the moonpool work table is moveable independently.

With independent movement of at least the second set of table doors, the user is able to position the table doors to guide an item, in particular a conduit, therethrough and down into the moonpool in a desired trajectory which may not be vertical. The box arrangement assists, especially with the opening funnel arrangement created by the edges of the vertical faces meeting as discussed above.

In another embodiment of the present invention, the table doors of the second set of table doors are separately moveable. That is, each second door can be moved independently of the other second door, optionally in addition to any complementary and coordinated movement of the table doors of the second set, generally being movement which is equal and opposite.

Preferably, the second set of table doors overlap an edge of each of the first set of table doors when the first set of table doors are in a closed position based on the width of the second set of table doors. That is, once the first set of table doors are in such a closed position, the second set of table doors extends between the first doors, generally being between the front edges of the first doors, so as to be supported by each of the first doors, and so as to create an enclosed top surface around the item passing through the moonpool.

According to another embodiment of the present invention, the work table further comprises retractable auxiliary doors moveable behind the second set of double doors to occupy the space between the second set of double doors in their closed position and an edge of the work table. That is, space left between the edges of the second set of table doors not engaged with the item passing through the moonpool, and the edge of the moon table, can be occupied by a further set of auxiliary doors able to close the areas of the moonpool opening otherwise free, and therefore increase the top surface of the moonpool work area covered by the doors other than that area around the item passing through the moonpool work table.

According to another embodiment of the present invention, each table door of the first set of table doors further comprises a deflector extendable from the vertical face. Preferably, the deflectors are equal and opposite, and/or the deflectors taper outwardly from their top to their bottom. Optionally, each of the deflectors is moveable independently.

In another embodiment of the present invention, the second set of table doors are retractable from their open position to a further open position to extend the size of the moonpool opening.

According to a second aspect of the present invention, there is provided a vessel having a moonpool and a moonpool work table as defined herein. Many vessels are elongate, having a general length greater than their width, and as such have a longitudinal direction or access based on their length or direction of travel or otherwise between the bough and the stern. Preferably, in the vessel of the present invention, the first set of table doors are moveable in a direction transverse to the longitudinal direction of the vessel, and the second set of table doors are moveable in the longitudinal direction of the vessel.

According to another aspect of the present invention, there is provided a method of aligning a conduit passing through a moonpool of a vessel, said moonpool having a moonpool work table as defined herein, comprising at least the steps of:

(i) moving the first set of table doors from an open position to a first position next to or near to the conduit;

(ii) moving the second set of table doors from an open position to a position next to or near to the conduit;

(iii) aligning the conduit to pass through the moonpool based on a position set by the location of the first and second table doors.

Optionally, the first set of table doors include extendable deflectors, and further comprising the step of moving the deflectors from a retracted position to an extended position further aligning the conduit within the moonpool.

Generally, there is a tower located next to the moonpool on the vessel, although the present invention is not limited thereto. Such a tower can provide the guide means for the direction of the items such as a pipeline or conduit passing through the moonpool, usually based on the use of one or more guide means such as caterpillar tracks located along the tower.

BRIEF DESCRIPTION OF THE DRAWINGS

Embodiments of the present invention will now be described by way of example only and with reference to the accompanying drawings in which.

DESCRIPTION OF PREFERRED EMBODIMENTS

Figure 1:
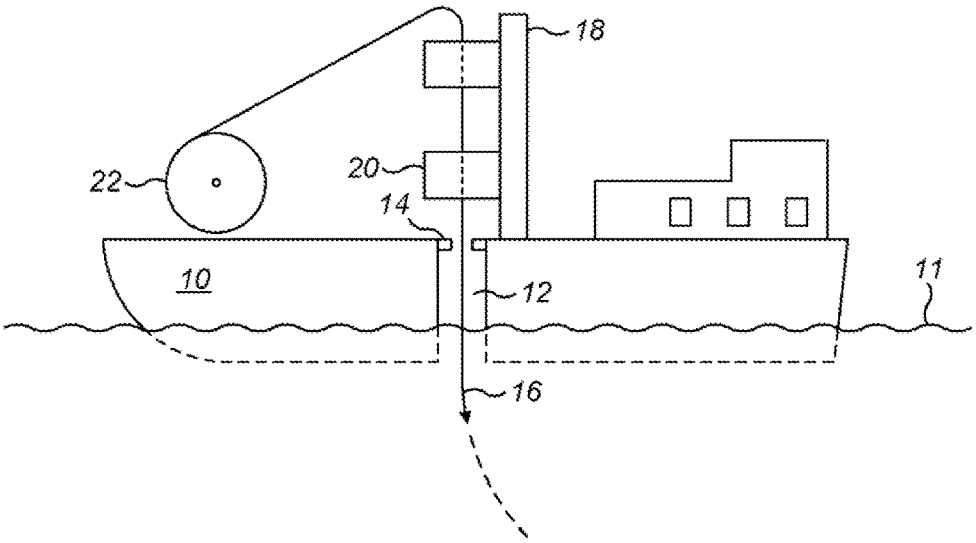
FIG. 1 is a schematic side cross sectional view of a vessel having a reel, tower and moonpool and pipeline being laid.

Referring to the drawings, FIG. 1 shows a vessel 10 generally being a sea going vessel in a sea 11. The vessel 10 has a moonpool 12 extending between a general work deck or surface and the bottom of the vessel 10, through which a pipeline 16 extends. The pipeline 16 is provided by a reel 22 and passes down through guide means 20 on a tower 18 next to the moonpool 12. The moonpool 12 has a moonpool work table 14 based on two doors.

Figure 2:
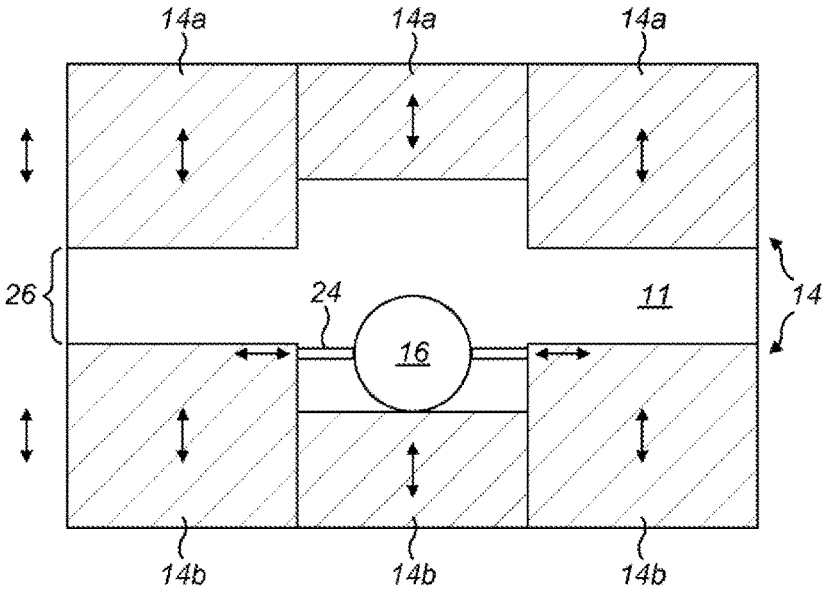
FIG. 2 is a top view of a prior art moonpool work table and pipeline.

FIG. 2 shows a prior art moonpool work table 14 having a first door 14*a* and second door 14*b*. Each of the doors 14*a,b* has three sections, generally a middle section and two outer sections. FIG. 2 shows the pipeline 16 and the two outer sections of the second table door 14*b* having extendable supports 24. The space between the front opposing edges of the first and second doors 14*a,b* can be defined as the opening 26 or envelope of the moonpool 12, below which is the sea 11.

Figure 3:
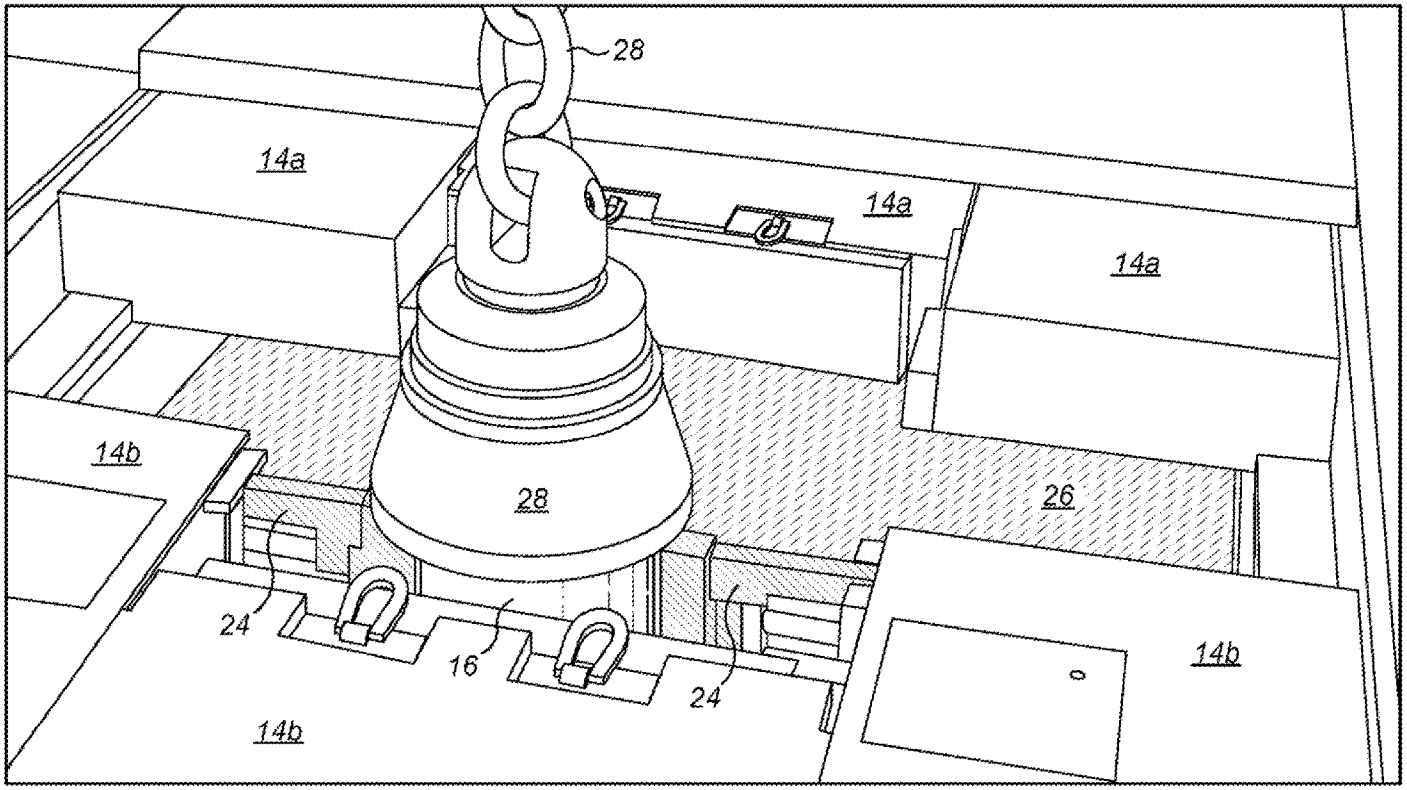
FIG. 3 is a perspective view of FIG. 2.

FIG. 3 is a more detailed and top perspective view of FIG. 2 which shows the pipeline 16 being held in place by the supports 24 and against the vertical face of one section of the second table door 14*b*. The pipeline 16 is supported by a chain and end fitting 28.

As can be seen from FIG. 3 there is no control in the trajectory of the pipeline 16 if the pipeline 16 escapes out of the area between by the supports 24. Currently, crude manual methods are required to retrieve the pipeline 16 back into its intended trajectory through the moonpool work table 14. Secondly, there are a lot of sharp edges as shown in FIG. 3 which could harm the pipeline 16 in any significant contact. Lastly, to attach any fitting to the pipeline 16, and in particular an intermediate fitting such as a buoyancy module, generally having a diameter greater than that of the pipeline 16, several operations are required where the pipeline has to be captured and released to pass the fitting through the moonpool. With moonpool doors of a conventional arrangement, once the pipeline 16 escapes from the intended envelope provided by the supports 24, realignment is required as well as the risk of damage to the pipeline 16 as discussed above.

Figure 4:
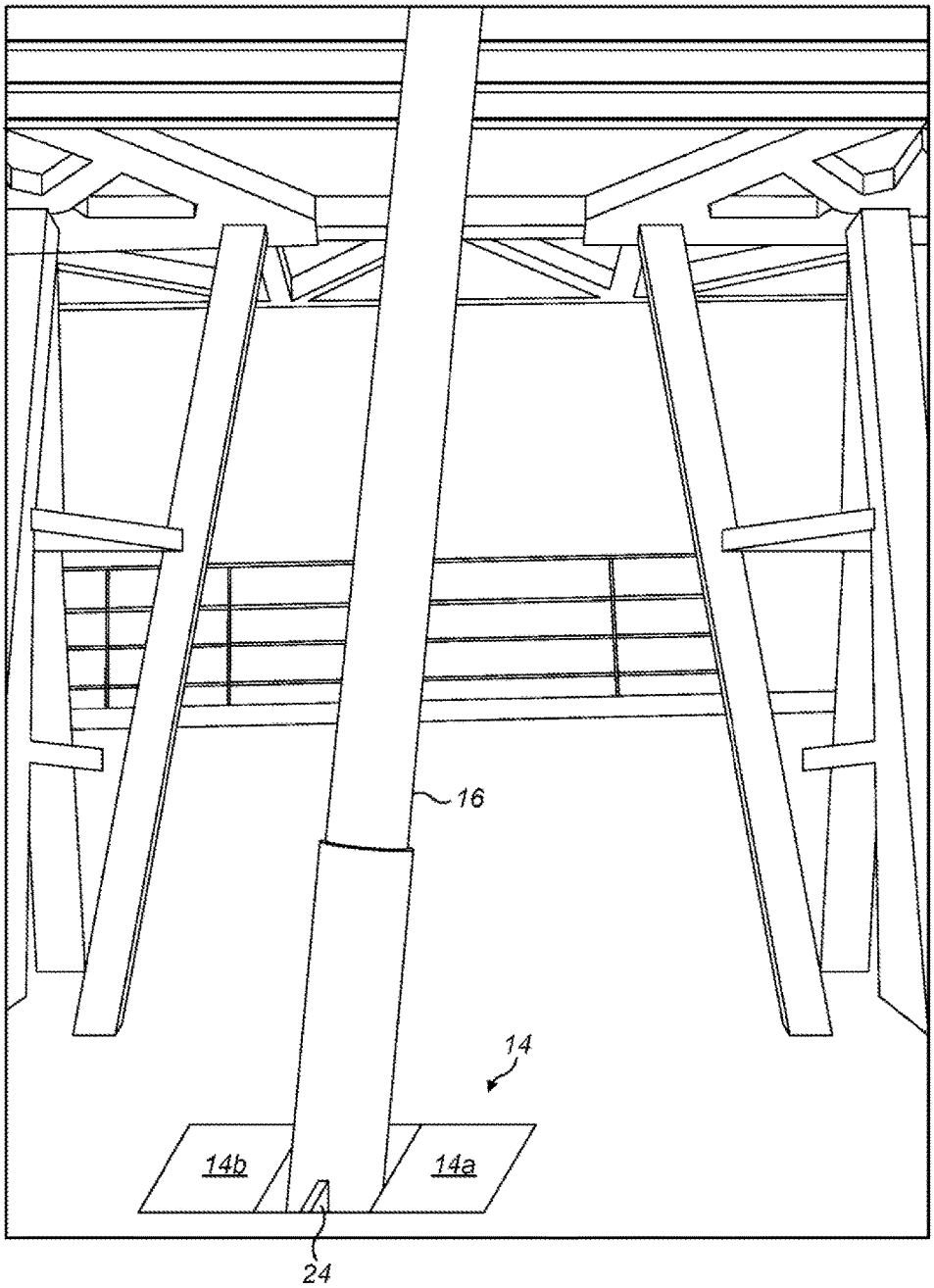
FIG. 4 is a side view of a pipeline being laid through a prior art moonpool work table.

FIG. 4 shows an example of a pipeline 16 required to have a trajectory through the moonpool 12 that is not vertical. Laying and recovery of conduits in the offshore industry commonly requires a pipeline trajectory to be not vertical to account for many factors in the laying or recovery operation. Whilst guide means 20 in a tower 18 above the moonpool 12 provides some trajectory alignment, such an alignment also needs to be obtained through the moonpool 12, and is therefore intended to be provided by working out best positioning of the moonpool work table, in particular the opposing doors 14. Using a conventional moonpool work table makes this difficult.

Figure 5:
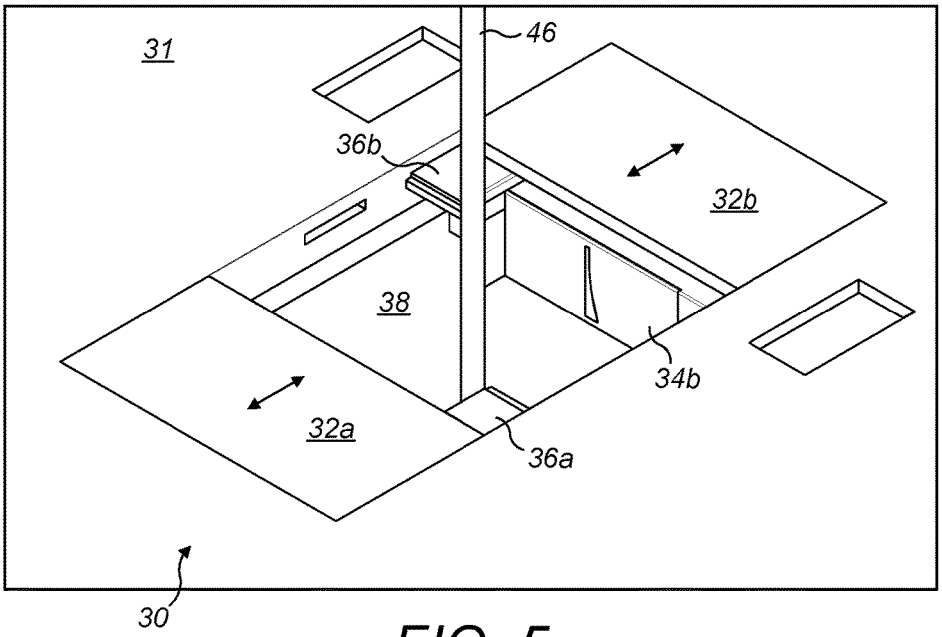
FIG. 5 is a schematic perspective view of a moonpool work table according to one embodiment of the present invention in an open position.

FIG. 5 is a top perspective schematic view of a moonpool work table 30 according to one embodiment of the present invention. The work table 30 comprises a first set of opposing table doors 32*a*, 32*b*, each having a vertical face (only one vertical face 34*b* shown in FIG. 5) which extends downwardly from a front opposing edge of the relevant table door 32*a,b* of the first set downwardly.

FIG. 5 also shows a second set opposing table doors 36*a*, 36*b*. In one alternative arrangement, the second set of table doors 36*a,b* are retractable from their open position as shown in FIG. 5 to overlap more with the first set of table doors 36*a,b*, thereby to increase the size of the opening 38 thereinbetween.

The first and second sets of table doors 32*a,b*, 36*a,b* are both in an open position, and are wholly or substantially 'flush' or co-planar with the general surface of the deck 31 of a vessel having the moonpool below the moonpool work table 30. As such, the area or space between the horizontal edges of the first and second sets of table doors 32*a,b*, 36*a,b* provide the 'opening' 38 through which a conduit can pass into the moonpool. Naturally, it is intended that the opening 38 provides sufficient space for the passage of all expected conduits and fittings to be provided therethrough. FIG. 5 shows a pipeline 46 is a nominal conduit.

Figure 6:
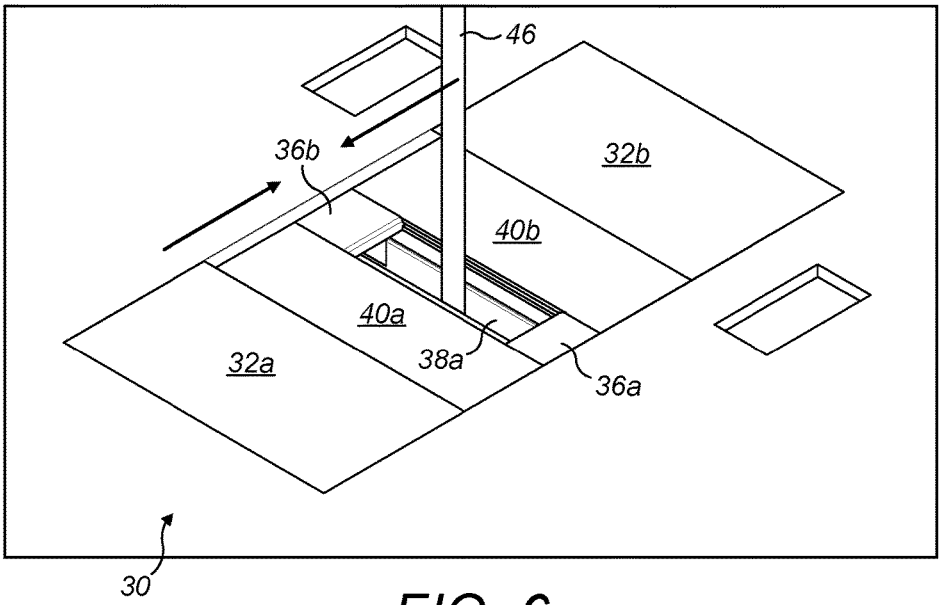
FIG. 6 corresponds to FIG. 5 with the moonpool work table in a first closed position.

FIG. 6 is a first development of the moonpool work table 30 shown in FIG. 5, wherein the first set of opposing table doors 32*a,b* move between the open position as shown in FIG. 5, and a first closed position as shown in FIG. 6. Optionally, each table door of the first set of table doors 32*a,b* comprises two or more panels, and at least one of said panels is moveable between an open position, optionally in a retracted alignment with one or more other panels, and an extended position able to provide one or more closed positions for the table doors. FIG. 6 shows an embodiment of this arrangement, wherein each table door of the first set of able doors 32*a,b* has an extending panel 40*a,b* respectively which has telescopically extended forwardly towards the other table door 32*a,b* to reduce the size of the opening 38 to a first reduced opening 38*a*. In this way, a part or panel of the first set of table doors 32*a,b* remain stationary whilst being able to house one or more extending panels able to provide at least the closed position of the first set of table doors 32*a,b*.

Optionally, each table door of the first set of able doors 32*a,b* and/or each and every extending panel 40*a,b* can operate independently, such that they can be guided to a closed position around a non-central and/or non-vertical conduit 46.

Figure 7:
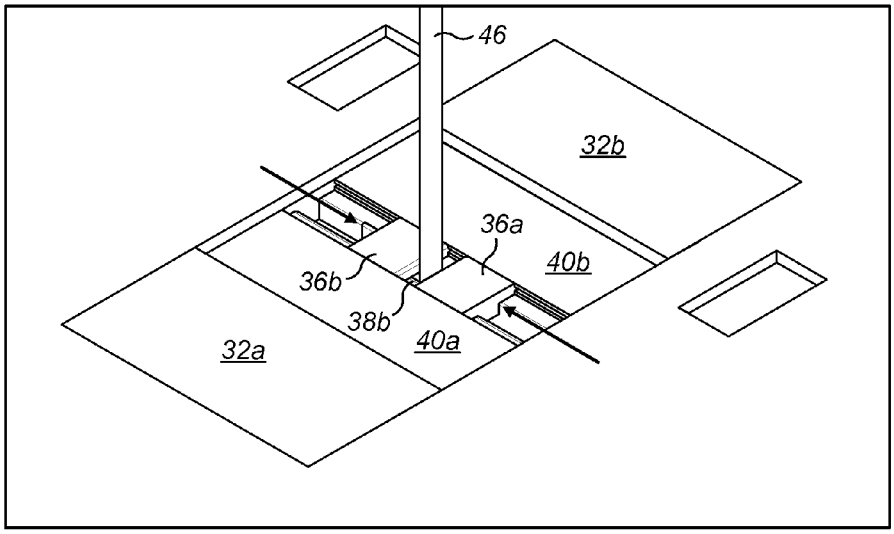
FIG. 7 corresponds to FIG. 5 with the moonpool work table in a second closed position.

FIG. 7 shows a further development of the moonpool work table 32 operation of FIG. 6, wherein the table doors of the second set of table doors 36*a,b* move from their open position as shown FIG. 5 to a first closed position as shown in FIG. 7. Such movement is in a transverse direction to that of the movement of the first set of table doors 32*a, b* as shown in FIG. 6.

Optionally, each table door of the second set of table doors 36*a,b* can operate independently, such that they can be guided to a closed position around a non-central and/or non-vertical conduit 46.

Apparatus, devices, etc. such as actuators, able to provide the movement of the table doors, are not shown in the Figures herewith, but are well known to the person skilled in the art. Such actuators include hydraulic actuators and ram and piston arrangements, able to provide the required controlled movement of the table doors as required by a user.

FIG. 6 shows an arrangement whereby the second set of table doors 36*a,b* overlap an edge of each of the first set of table doors 32*a,b* or at least a portion thereof being the extended panels 40*a,b* when the first set of table doors 32*a,b* are in their closed position as shown in FIG. 6.

Thus, FIG. 7 shows movement of the second set of table doors 36*a,b* along the forward edges of the first set of table doors 32*a,b* or more particularly, along the forward edges of both the extended panels 40*a, b*. Optionally, the relevant edges of the second set of table doors 36*a, b* have complementary, in particular mating, surfaces to match those of the first set of table doors 32*a,b*.

FIG. 7 shows the movement of the first and second set of table doors 36*a,b* from their open positions to at least a first closed position to have provided a further reduced opening 38*b* thereinbetween, and to be in close alignment with the conduit 46 as described in more detail below.

Figure 8:
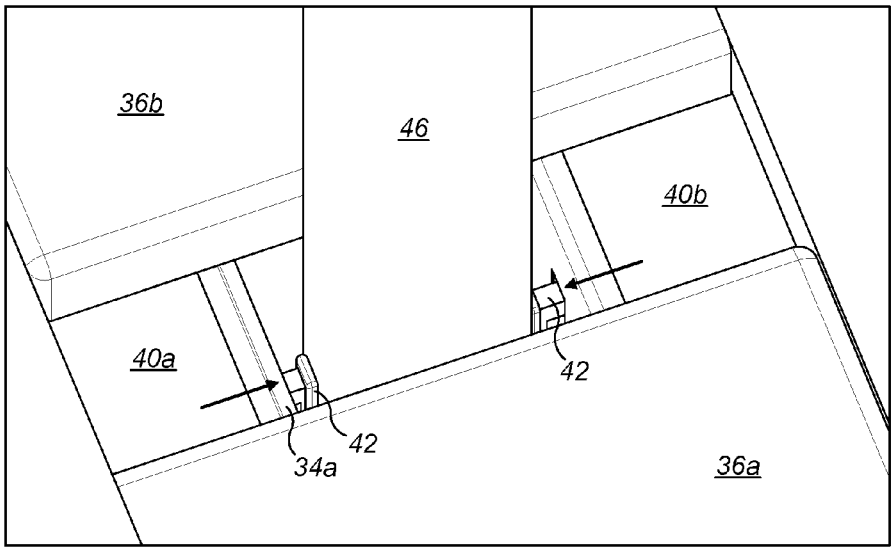
FIG. 8 corresponds to FIG. 5 with the moonpool work table in a third closed position.

FIG. 8 shows a further development of the arrangement shown in FIGS. 5-7 wherein each vertical face, 34*a,b* of the first set of table doors 32*a,b* further comprises a deflector 42 extendable from the vertical face 34*a,b*. The deflectors 42 extend to engage the surface of the conduit 46.

Figure 9:
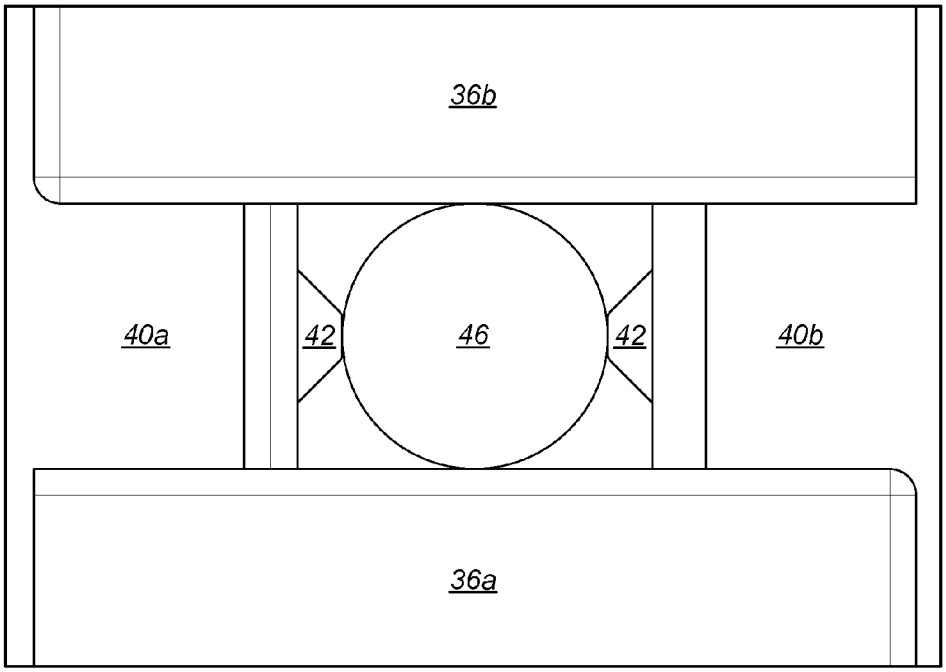
FIGS. 9 and 10 are top views and bottom views respectively of a moonpool work table according to an embodiment of the present invention in a closed position around a first pipeline.

FIG. 9 is a top view of the close or constricted arrangement shown in FIG. 8 whereby the conduit 46 is clearly engaged with the deflectors 42 and the front edges of the second set of table doors 36*a,b*. The arrangement of the first set of table doors 32*a,b*, and optionally the deflectors 42 as shown in FIGS. 8 and 9, and the second set of table doors 36*a,b*, provide a close 'deflector box'. That is, an area or space constricted by the front edges of the table doors, or any extendable part thereof, so as to box in the pipe and protect it from damage, whilst providing the relevant constraints needed. In addition, the deflector box is able to provide control over any non-central and/or non-vertical alignment necessary or desired as discussed in more detail below.

Figure 10:
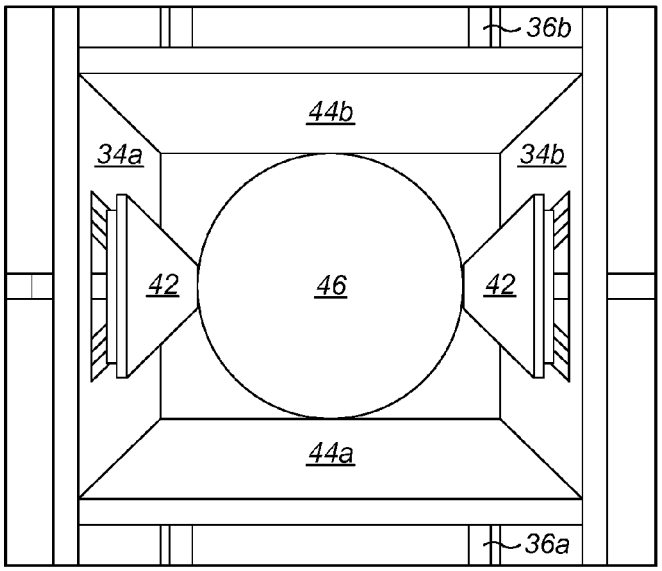

FIG. 10 shows a bottom perspective view of the arrangement of FIG. 8 with an element of perspective. FIG. 10 shows each table door of the second of table doors 36*a,b* having a vertical face 44*a,b* respectively extending downwardly into the moonpool in the same manner as the vertical faces 34*a,b* of the first set of table doors 32*a,b*.

It can be seen that the present invention is able to move the first and second of table doors 32*a,b*, 36*a,b* into any number of closed positions that provide constriction, generally with minimum spacing, around the conduit passing through the moonpool table. During the passage of the conduit through the moonpool table, there will generally be one closed position to suit the pipeline diameter.

Figure 11:
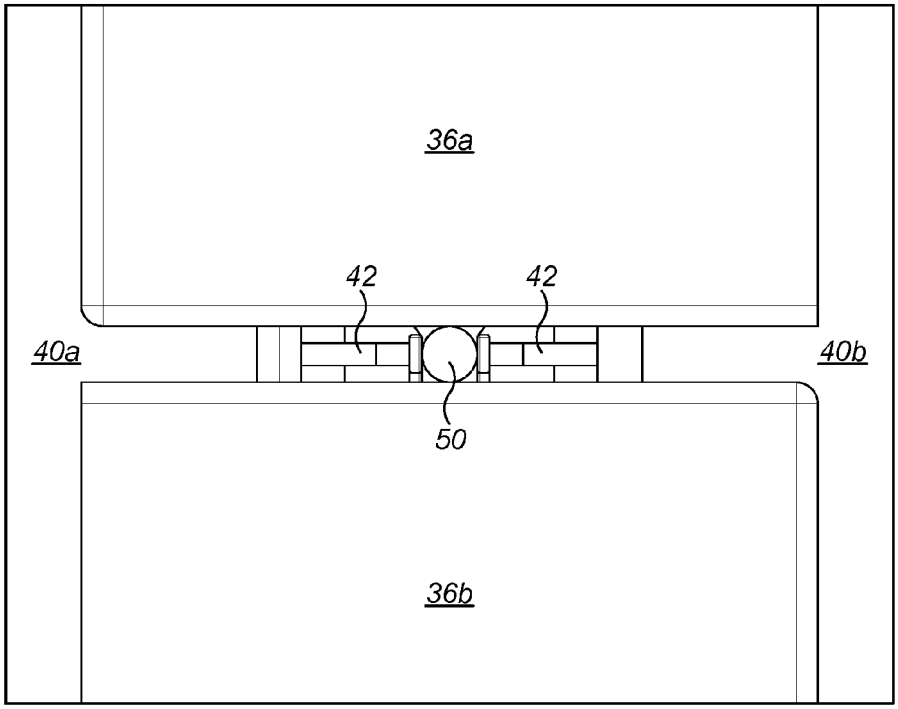
FIGS. 11 and 12 are top views and bottom views respectively of a moonpool work table according to an embodiment of the present invention in a closed position around a second pipeline.
Figure 12:
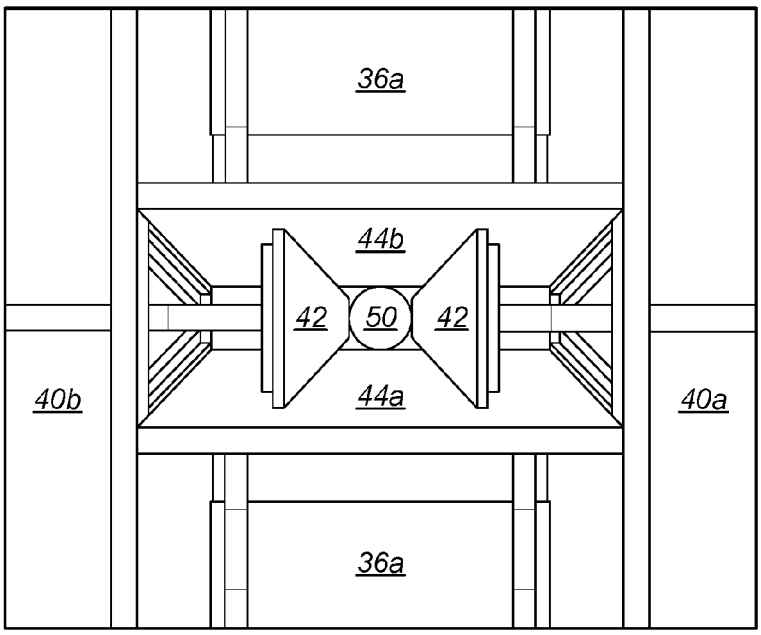

FIGS. 11 and 12 show a similar arrangement to that in FIGS. 9 and 10 for the application of the moonpool work table 30 around a second conduit 50 being thinner or smaller than the first conduit 46 as shown in drawings 7-10. As shown in FIGS. 11 and 12, the deflectors 42 are extended further and the edges of the second set of table doors 36*a,b* are closer, such that in the same way, a deflector box is provided by the edges of the deflectors and doors, but the deflector box provided is smaller.

Figure 13A:
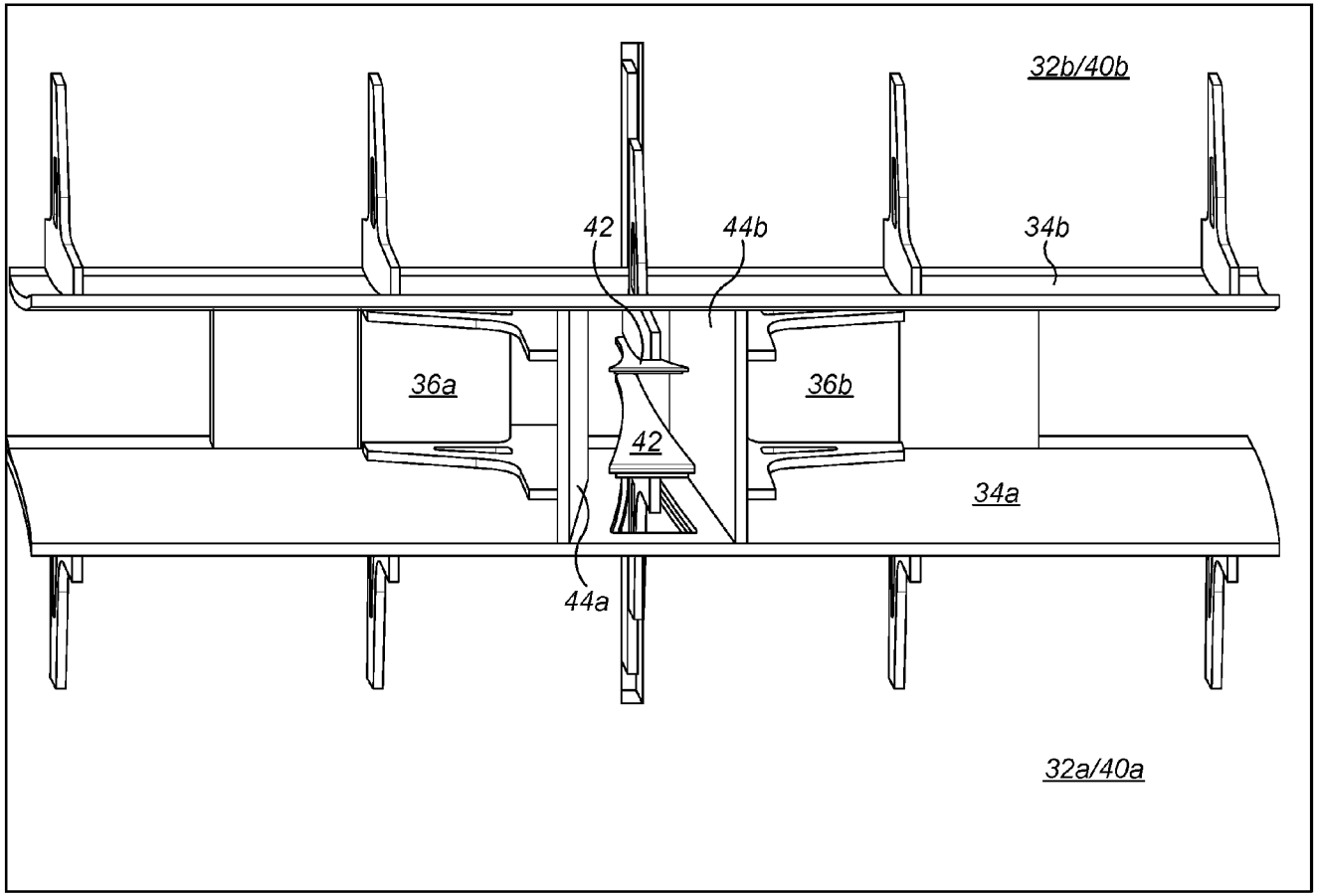
FIGS. 13*a* and 13*b* are bottom perspective and side cross-sectional views of a moonpool work table according to the present invention.

FIG. 13*a* is an bottom perspective view of most of the moonpool work table 30, showing the co-operation and meeting of the vertical faces 34*a,b* (of the first set of table doors 32*a,b* not shown), and the second set of table doors 36*a,b* each having a vertical face 44*a,b*, and the deflectors 42 extended from the vertical faces 34*a,b*. No conduit or pipeline is shown in FIG. 13*a* to assist clarity.

Figure 13B:
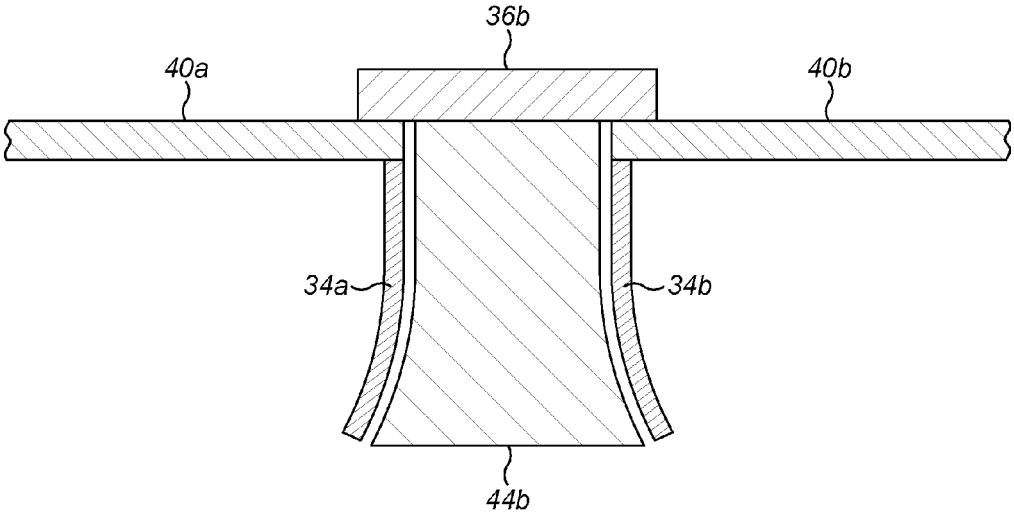

FIG. 13*b* shows a cross sectional side view of the downward relationship between the vertical faces 34*a,b* and one second door 36*b* and its depending vertical face 44*b*.

FIGS. 13*a* and *b* together show the arrangement of the vertical faces 34*a,b* curving inwardly towards the table doors 32*a,b* from their top to their bottom; and wherein vertical faces 44*a,b* of the second set of table doors 36*a,b* taper outwardly from their top to their bottom. FIG. 13*a* also shows wherein the deflectors 42 are equal and opposite, and taper outwardly from their top to their bottom. Where the nature of the curvature and tapering of these vertical faces and deflectors are sufficiently complementary, they can provide a downwardly opening funnel arrangement thereinbetween which has no sharp edges and which can continue any non-vertical guidance or alignment of a conduit therethrough.

The present invention is not limited by the nature of the conduit to pass through the moonpool work table. Preferably, the present invention is able to work with a conduit or product having an outer diameter within at least the range of 100 mm-1000 mm, such as in the range 114 mm to 800 mm. The present invention is also designed to accommodate any conventional expected non-vertical alignment of a conduit therethrough, such being up to or beyond 9° from a vertical axis.

Figure 14:
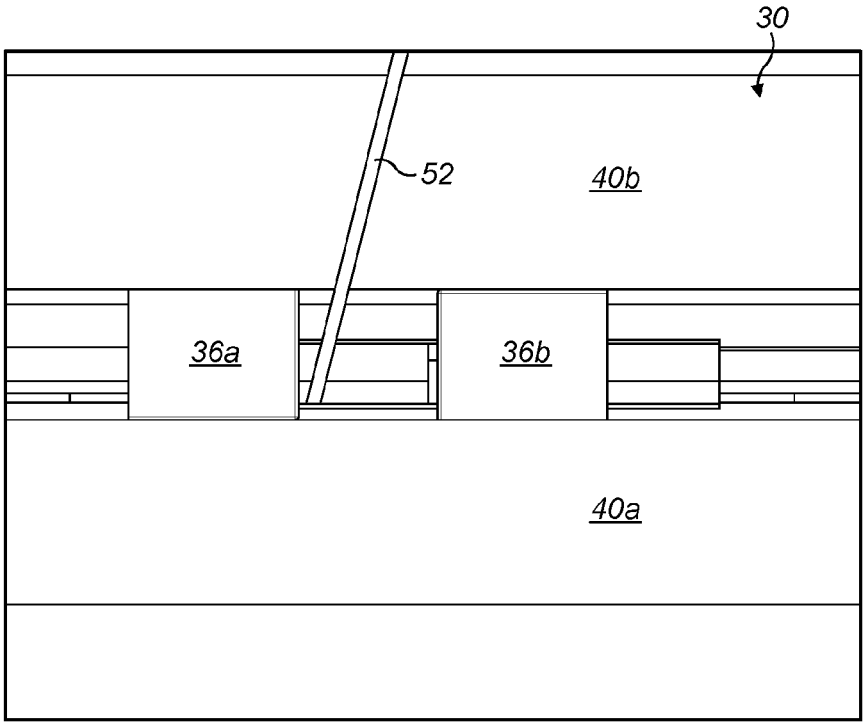
FIG. 14 is a top perspective view of an operation of the second set of doors in relation to a pipeline.
Figure 15:
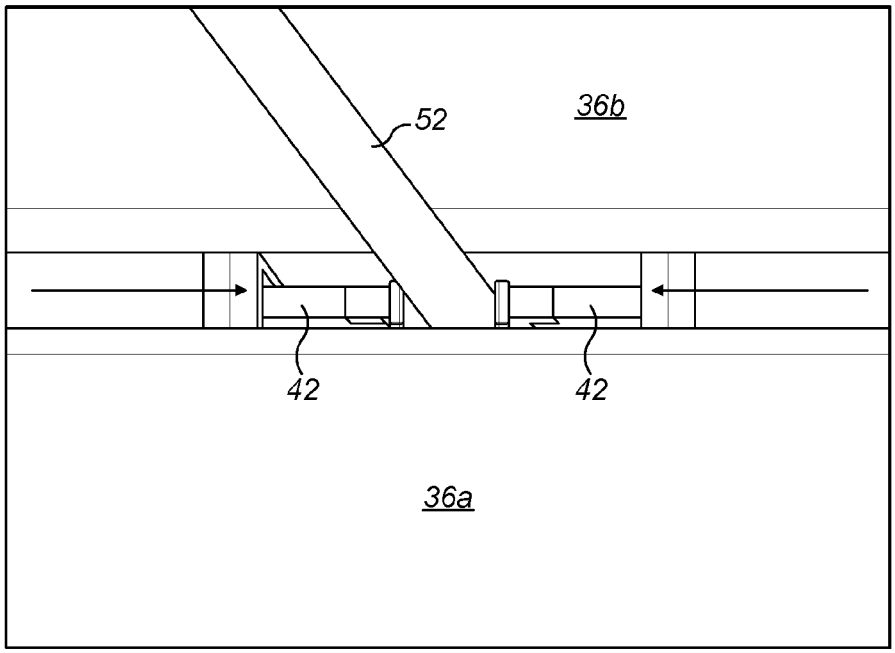
FIG. 15 is a top perspective view of an operation of retractable deflectors in relation to a pipeline.

FIG. 14 shows a conduit 52 passing through the moonpool work table 30 having a non-vertical alignment. For this, the second set of table doors 36*a,b* can be operated independently such that one such table door can be moved to assist the desired trajectory of the pipeline 52. Further operation of the deflectors 42 around the non-vertical pipeline 52 is shown in FIG. 15, where the deflectors 42 can again be operated independently of each other so as to provide a non-central direction for the pipeline 52 through the moonpool work table 30.

In particular, movement of the table doors and any deflectors in an independent manner allows the present invention extensive operational ability to achieve a desired moonpool and laying trajectory whilst still providing a tight and easily governable deflector box around the conduit. In this way, the conduit catenary can adapt to its natural deviation (off lead), whilst still within the projected area of the vertical faces and deflectors of the moonpool work table.

Figure 16:
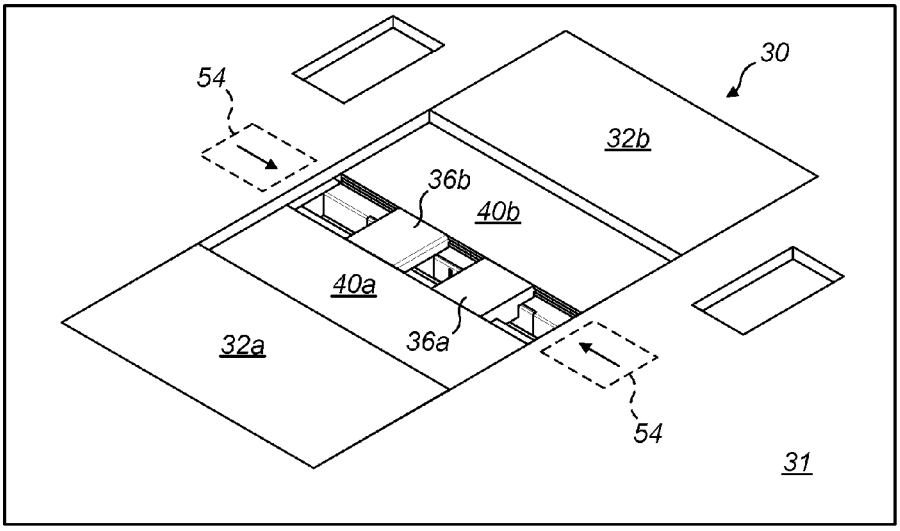
FIGS. 16 and 17 are top perspective views of retractable auxiliary doors useable in a moonpool work table of the present invention.
Figure 17:
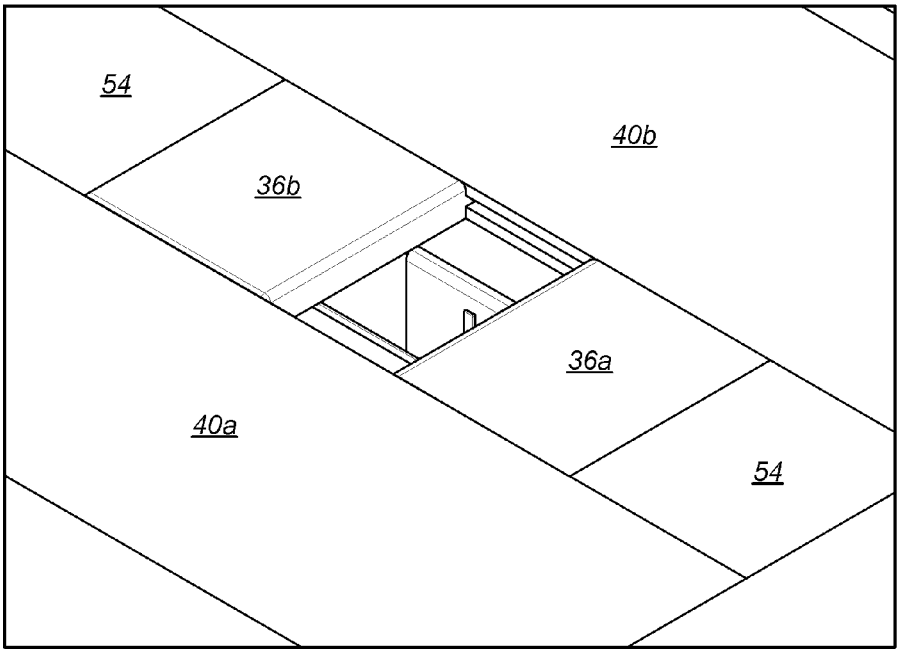

FIG. 16 shows the moonpool work table 30 further comprising retractable auxiliary doors 54, preferably housed when not required under the deck 31. As the second set of table doors 36*a,b* move from their open position to a closed position, such as shown in FIG. 16, the auxiliary doors 54 are movable behind the second set of table doors 36*a,b* to occupy the space between the second set of table doors 36*a,b* in their closed position and an edge of the work table 30 as shown in FIG. 17. In this way, the working surface of the moonpool work table 30 is increased, and undesired gaps between the first set of table doors 32*a,b* have been covered by the auxiliary doors 54 for the avoidance of accidents, etc. Retraction of the auxiliary doors 54 when desired to open the second set of table doors 36*a,b* can be carried out in reverse manner.

Figure 18:
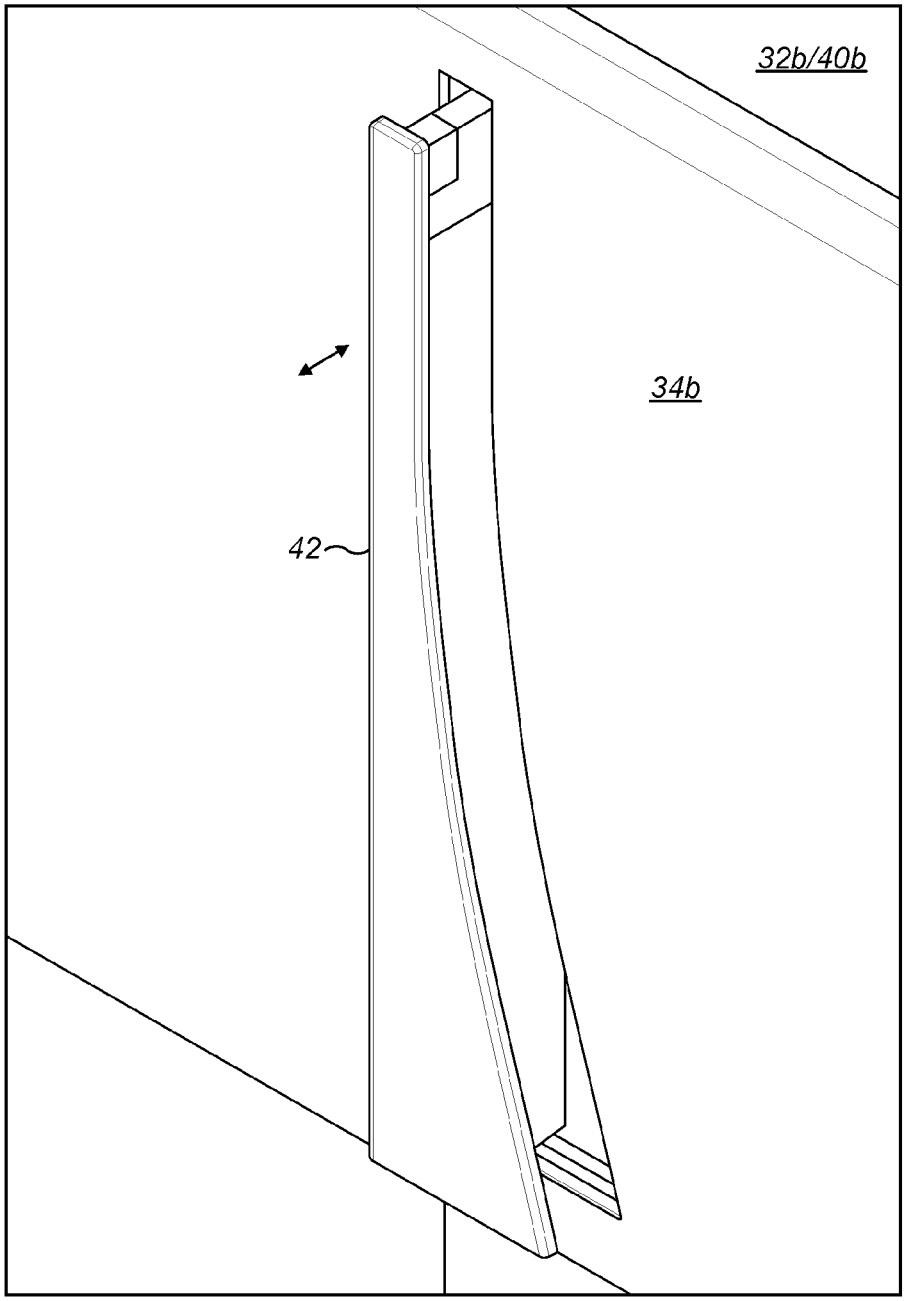
FIG. 18 is perspective enlarged view of a retractable deflector in an extended position of a first table door.
Figure 19:
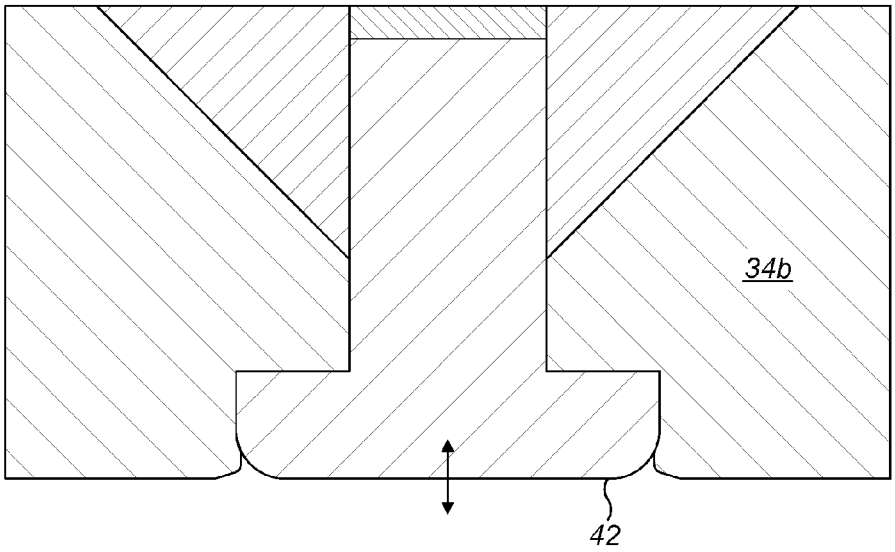
FIG. 19 is a top cross sectional view of the retractable deflector of FIG. 18 in a closed position with a first table door.

FIG. 18 shows a perspective view of a deflector 43 in more detail, and in particular its tapering from its top to its bottom. As also shown in FIG. 19, the deflector 42 is intended to fit closely or snuggly within the vertical face 34*b* of a first table door 32*b* in its retracted position, so as to reduce or avoid any sharp edges.

Figure 20:
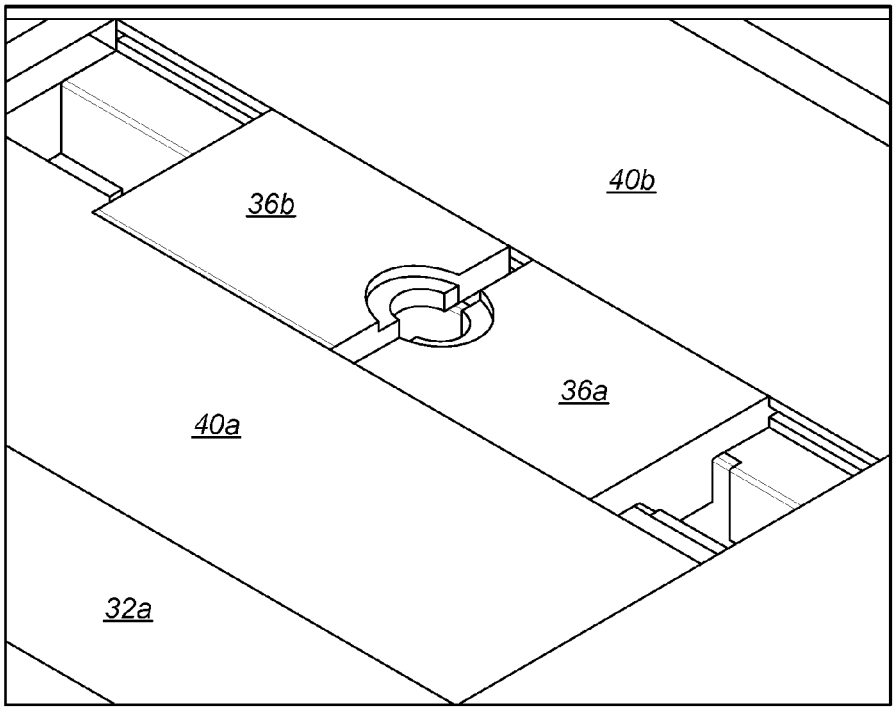
FIG. 20 is a top perspective view of a moonpool work table according to another embodiment of the present invention with adapted second doors.

FIG. 20 shows a further embodiment of the present invention, wherein the front portion of each door of the second set of table doors 36*a,b* have been shaped to include a C-collar which is useable with a flex hang off.

Various modifications and variations to the described embodiments of the invention will be apparent to those skilled in the art without departing from the scope of the invention as defined herein. Although the invention has been described in connection with specific preferred embodiments it should be understood that the invention as defined herein should not be unduly limited to such specific embodiments.

The invention claimed is:

1. A moonpool work table providing an opening to a moonpool comprising a first set of opposing table doors having opposing vertical faces and moveable between an open position and one or more closed positions, and a second set of opposing table doors moveable between an open position and one or more closed positions in a transverse direction to that of the first set of table doors, said moonpool work table further comprising retractable auxiliary doors moveable behind the second set of table doors to occupy a space between rear edges of the second set of table doors in a closed position and an edge of the work table.

2. A moonpool work table as claimed in claim 1 wherein each of the first set of table doors comprises a series of panels.

3. A moonpool work table as claimed in claim 2 wherein the vertical faces of the first set of table doors extend across the width of the moonpool work table.

4. A moonpool work table as claimed in claim 1, wherein the vertical faces of the first set of table doors curve inwardly towards the table doors from their top to their bottom.

5. A moonpool work table as claimed in claim 1, wherein the second set of table doors overlaps an edge of each of the first set of table doors when the first set of table doors are in a closed position.

6. A moonpool work table as claimed in claim 1, wherein each table door of the first set of table doors is moveable independently.

7. A moonpool work table as claimed in claim 1, wherein each table door of the second set of table doors is moveable independently.

8. A moonpool work table as claimed in claim 1, wherein each table door of the second set of table doors has a vertical face.

9. A moonpool work table as claimed in claim 8 the vertical faces of the second set of table doors taper outwardly from their top to their bottom.

10. A moonpool work table as claimed in claim 1, wherein each vertical face of the first set of table doors further comprises a deflector extendable from the vertical face.

11. A moonpool work table as claimed in claim 10 wherein the deflectors are equal and opposite.

12. A moonpool work table as claimed in claim 10, wherein the deflectors taper outwardly from their top to their bottom.

13. A moonpool work table as claimed in claim 10, wherein each of the deflectors is moveable independently.

14. A moonpool work table as claimed in claim 1, wherein the second set of table doors is retractable from their open position to a further open position to extend the size of the moonpool opening.

15. A vessel having a moonpool and a moonpool work table as defined in claim 1.

16. A vessel as claimed in claim 15 wherein the first set of table doors is moveable in a direction transverse to the longitudinal direction of the vessel, and the second set of table doors is moveable in the longitudinal direction of the vessel.

* * * * *